US005730204A

United States Patent [19]

Shimmell

[11] Patent Number: 5,730,204

[45] Date of Patent: Mar. 24, 1998

[54] MULTISHOT DIE CASTING APPARATUS

[75] Inventor: Dennis S. Shimmell, Hudsonville, Mich.

[73] Assignee: Nelson Metal Products Corporation, Grandville, Mich.

[21] Appl. No.: 680,513

[22] Filed: Jul. 9, 1996

[51] Int. Cl.[6] ..... B22D 17/10

[52] U.S. Cl. ..... 164/312; 164/130; 264/328.8; 425/572

[58] Field of Search ..... 164/129, 130, 164/113, 133, 312; 264/328.8, 297.2; 425/572, 588

[56] References Cited

U.S. PATENT DOCUMENTS 4,546,812 10/1985 Tiegel ..... 164/130
5,380,184 1/1995 Von Holdt, Sr. ..... 264/328.8

*Primary Examiner*—Kuang Y. Lin
*Attorney, Agent, or Firm*—Warner Norcross & Judd

[57] ABSTRACT

A die casting apparatus having a die assembly with multiple die cavities that are filled with sequential shots of metal. The apparatus includes a slide that is movable to selectively define a flow path between the metal delivery system and the desired die cavity. By moving the slide between shots, the die cavities can be filled in sequence without opening the die assembly.

14 Claims, 4 Drawing Sheets

MULTISHOT DIE CASTING APPARATUS

BACKGROUND OF THE INVENTION

The present invention relates to die casting equipment, and more particularly to a die assembly in which molten material is injected to create a cast article.

Die casting is a commonly used technology for fabricating a wide range of articles from molten material. Typically, two or more die parts are provided, each defining a void corresponding in shape to a portion of the article to be cast. When the die parts are brought together, these voids cooperate to define a die cavity in the shape of the article to be cast. Molten metal is introduced into the die cavity and allowed to cure—typically by cooling. Once the article is sufficiently cured, the die parts are opened and the cast article is removed. The die parts can be closed and the process repeated to cast the desired number of identical articles.

A conventional die casting apparatus is illustrated in FIG. 1, and generally designated 100. The die casting apparatus 100 includes a die assembly 108 that receives molten material from a shot sleeve assembly 110. The die assembly 108 includes an ejector die 102 mounted to a movable platen 126 and a cover die 104 mounted to a stationary platen 128. The dies 102 and 104 each define a void corresponding to a portion of the article to be cast. Together, these voids form a die cavity 106 corresponding to the shape of the article to be cast. In addition, the ejector die 102 also defines an inlet 132 (See FIG. 2) and a runner 124 that provide a flow path between the die cavity 106 and the shot sleeve 112 as described below. FIG. 2 illustrates the inner face of the ejector die 102 including the void 130, the runner 124, and the inlet 132.

The shot sleeve assembly 110 includes a shot sleeve 112 defining an internal bore 114. The shot sleeve 112 extends into the die assembly 108 and terminates at the inlet 132 such that the internal bore 114 is in communication with the die cavity 106 via the inlet 132 and the runner 124. The shot sleeve 112 includes a pour hole 116 through which molten material is poured into the shot sleeve. A plunger 118 reciprocates within the shot sleeve 112 to inject or force the molten metal from the internal bore 114 into the die cavity 106. The plunger 118 is connected to a hydraulic cylinder 120 by a plunger rod 122. Extension of the plunger 118 injects the molten metal within the sleeve 112 into the die cavity 106. Retraction of the plunger 118 withdraws the plunger 118 to permit filling the sleeve 112 for the next shot.

A conventional die assembly may include multiple die cavities 130*a–c* for casting multiple articles on single shot. Each cavity 130*a–c* is connected to the inlet 132 by a dedicated or shared runner. Consequently, the length of the casting cycle for a single shot is equal to the total time required to (a) close the die, (b) ladle molten material into the shot sleeve, (c) advance the plunger, (d) allow the molten material to cure sufficiently to maintain its shape when removed from the die, (e) retract the plunger, which may occur simultaneously with steps d, f, and/or g, (f) open the die, and (g) remove the cast article.

In addition, high pressure is required to inject molten material from the shot sleeve into the die cavity. The required pressure increases in a manner directly proportional to the surface of the total die cavity(ies). Therefore, the required pressure increases with both the size and number of the cast article(s). Such pressures provide a practical limitation on both the number and size of die cast parts capable of fabrication on a single shot.

SUMMARY OF THE INVENTION

The aforementioned problems are overcome by the present invention wherein a die assembly is provided with multiple independent die cavities filled by sequential shots without opening the die assembly between shots. The die assembly includes an ejector die and a cover die that together define a number of independent die cavities. The die assembly includes a movable slide for selectively directing molten metal from the shot sleeve to the desired independent die cavity. The slide is positioned for each shot to allow sequential filling of the die cavities.

In the presently preferred embodiment, the die assembly defines two independent die cavities. That is to say that the die cavities are not in fluid communication with one another. The ejector die defines a first runner extending between the first cavity and the material inlet and a second runner segment extending from the second die cavity partially, but not entirely, to the inlet. The slide defines a connecting passageway and is movable between a first position in which the passageway is nonfunctional and a second position in which the passageway connects the inlet and the second runner segment creating a flow path from the inlet to the second die cavity.

After the die is closed and prior to the first shot, the slide is placed in the first position so that the metal is directed into the first die cavity through the first runner. After the first shot of metal is sufficiently cured, the slide is moved to the second position creating a flow path from the inlet through the passageway and the second runner segment to the second die cavity. A second shot is then injected into the die assembly to fill the second die cavity. The die is then opened to remove all of the cast parts.

The present invention provides a unique die assembly that allows multiple articles to be cast in sequential shots without opening the die, thereby reducing the length of the casting cycle. First, the die of the present invention need not be opened until all of the die cavities are filled. This eliminates the time required to open and close the die between each article. Second, the average curing time per article is reduced. Conventionally, a cast article must be allowed to cure long enough for it to maintain its shape when removed from the die. With the present invention, however, the die is not opened until the last article cast in the die is cured. Therefore, only the last article requires the full curing time. The previous articles only need to cure long enough to prevent the material from flowing out of the die cavity when the plunger is retracted for the next shot.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
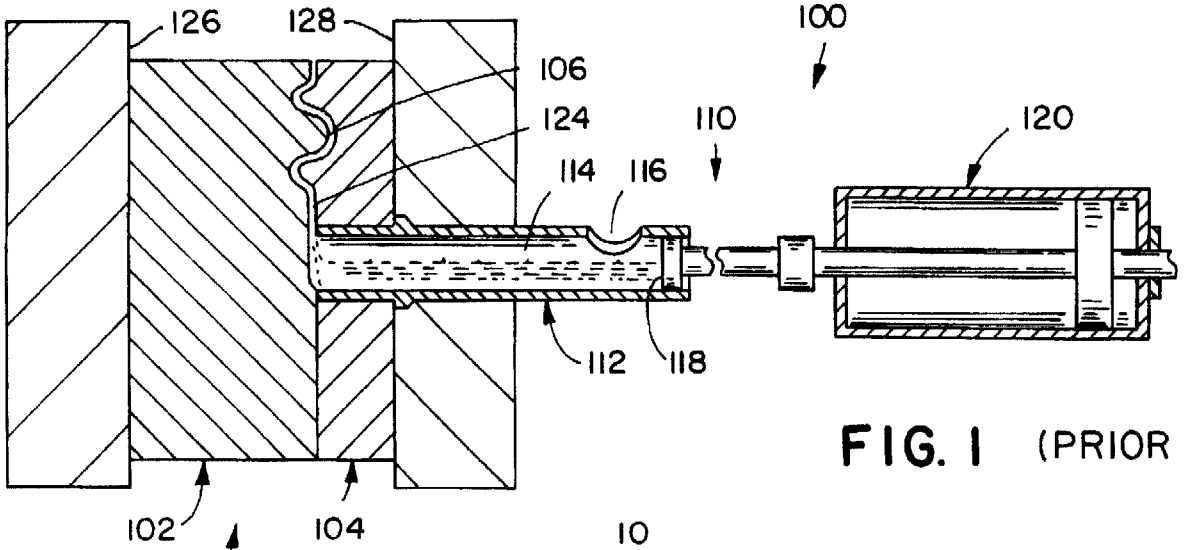
FIG. 1 (PRIOR ART)
FIG. 1 is a sectional, side elevational view of a die casting apparatus according to the prior art.
Figure 3:
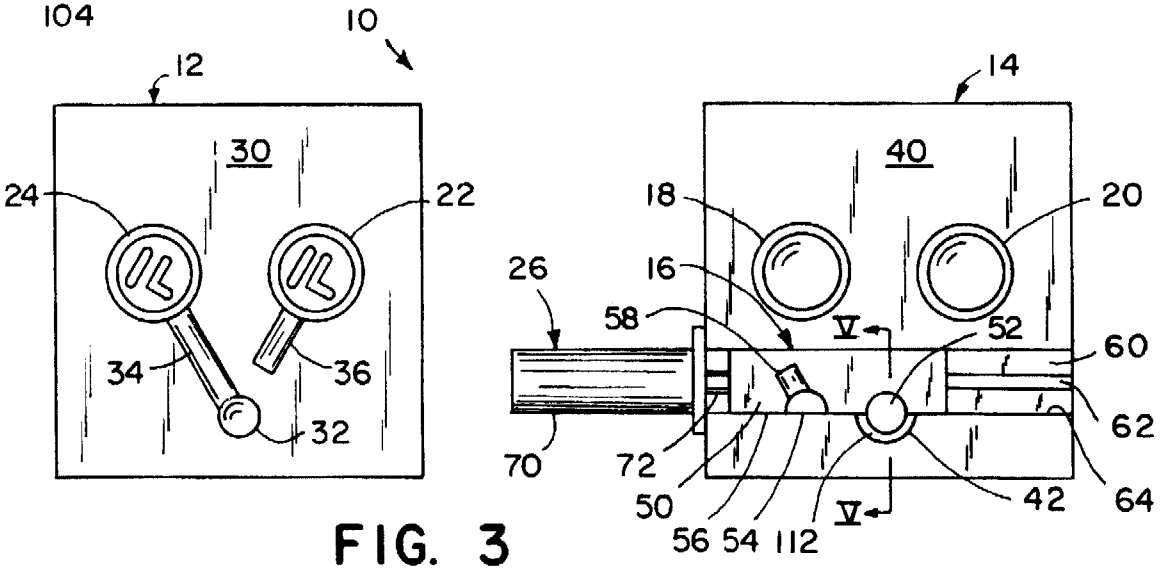
FIG. 3 is a front view of the ejector die and the cover die of the present invention with the slide in a first position.
Figure 2:
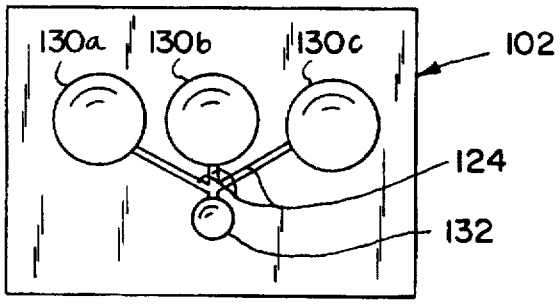
FIG. 2 (PRIOR ART)
FIG. 2 is a front view of an ejector die according to the prior art.

A die assembly according to a preferred embodiment of the present invention is illustrated in FIG. 3, and generally designated 10. The die assembly 10 is adapted for use with conventional die casting apparatus. FIG. 1 shows a prior art die casting apparatus 100 having a conventional die assembly 108 and a conventional shot sleeve system 110. The die assembly 10 of the present invention is intended to replace the conventional die assembly 108 shown in FIG. 1, and is integrated into the die casting apparatus 100 in a conventional manner. The die assembly 10 includes an ejector die 12 and a cover die 14 which are shown in FIG. 3 splayed open along their mating surfaces. The ejector die 12 and cover die 14 cooperate to define a plurality of distinct die cavities. The die assembly 10 also includes a valve for directing the molten metal to the desired die cavity. The valve includes a multishot slide 16 and a slide control mechanism 26. The slide 16 is movable by operation of the control mechanism 26 to selectively direct injected molten material into any one of the plurality of die cavities. In operation, molten material is ladled into the shot sleeve system 110 and then forced into the die assembly 10 by a conventional plunger arrangement. The multishot slide 16 is adjusted between shots to sequentially fill the die cavities without opening the die assembly 10. While the present invention is described in connection with a conventional metal die casting apparatus, it is also well suited for use with other types of injection molding systems, including polymeric injection molding systems.

The ejector die 12 is mounted to a movable platen (not shown) to allow the die assembly 10 to be opened to remove the cast article. The ejector die 12 is generally rectangular and includes a die face 30 that abuts the die face 40 of the cover die 14 when the die assembly 10 is closed. The ejector die face 30 defines a pair of voids 22 and 24 each corresponding in shape to a portion of one of the articles to be cast. When the die assembly 10 is closed, these voids 22 and 24 mate with corresponding voids 18 and 20 in the cover die 14 to define first and second die cavities (not shown). For purposes of this disclosure, voids 22 and 24 are generally cylindrical, however, the shape of the voids will vary from application to application to correspond with the shape of the article to be cast. The ejector die face 30 also defines an inlet 32 for receiving molten material flowing from the open end of the shot sleeve. The inlet 32 is a regressive conical void. The diameter of the inlet 32 at the surface of the die face 30 is preferably greater than the outer diameter of the shot sleeve. The ejector die face 30 further defines a runner 34 extending between void 24 and inlet 32, and a runner segment 36 extending from void 22 partially to inlet 32. The runner 34 is a semi-circular trough that defines a flow path for directing molten material from inlet 32 into the first die cavity. The runner segment 36 is also a semi-circular trough. However, runner segment 36 extends only partially between void 22 and inlet 32 so that a passageway is required to allow molten material to flow from the inlet 32 to the second die cavity. The remainder of the die face 30 is generally planar.

The cover die 14 is mounted to a stationary platen (not shown) and include a die face 40 that, as noted above, abuts with the ejector die face 30 when the die assembly 10 is closed. The cover die face 40 is generally planar and defines a pair of voids 18 and 20. The voids are generally cylindrical in the disclosed embodiment, however, they will vary in shape from application to application to match the shape of the desired article. The cover die 14 defines a bore 42 for receiving the shot sleeve 112. The diameter of the bore 42 is slightly larger than the outer diameter of the shot sleeve 112 to provide narrow tolerances therebetween. The shot sleeve 112 and cover die 14 are interconnected using conventional methods. The cover die face 40 defines a rectangular trough 60 and dovetail groove 62 for receiving the multishot slide 16. The trough 60 extends transversely across the die 14 with its bottom edge 64 in alignment with the axis of the shot sleeve 112. The groove 62 extends transversely across the die 14 along the center of the trough 60.

Figure 4:
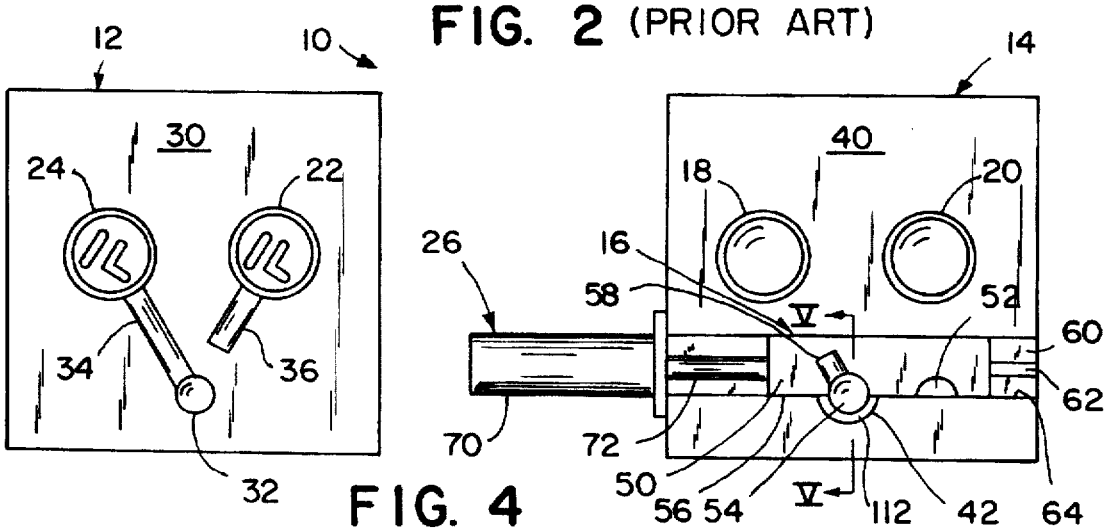
FIG. 4 is a front view of the ejector die and the cover die with the slide in a second position.
Figure 5:
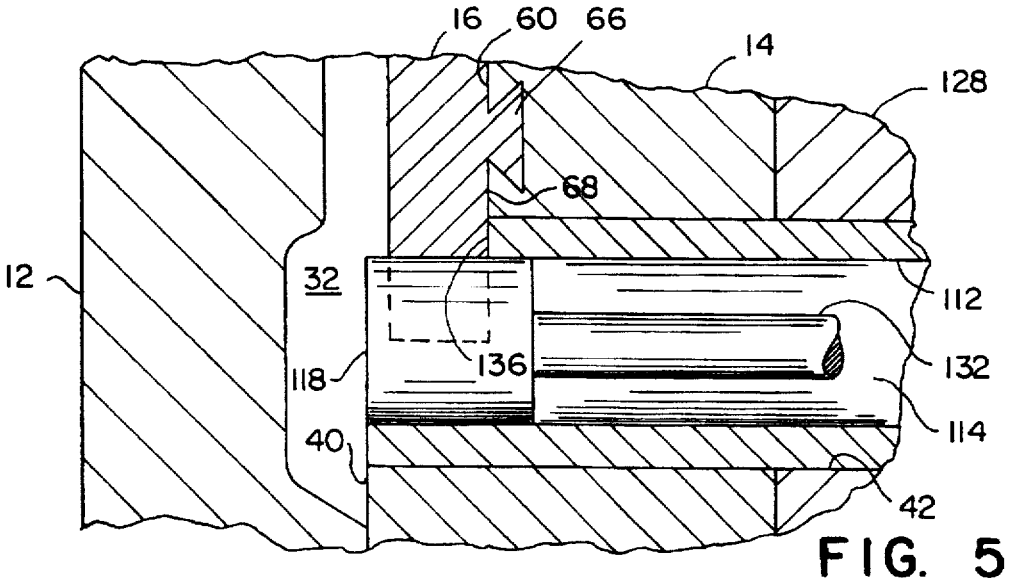
FIG. 5 is a sectional view taken along line V—V in FIG. 3 showing a portion of the die casting apparatus with the slide in the first position.
Figure 6:
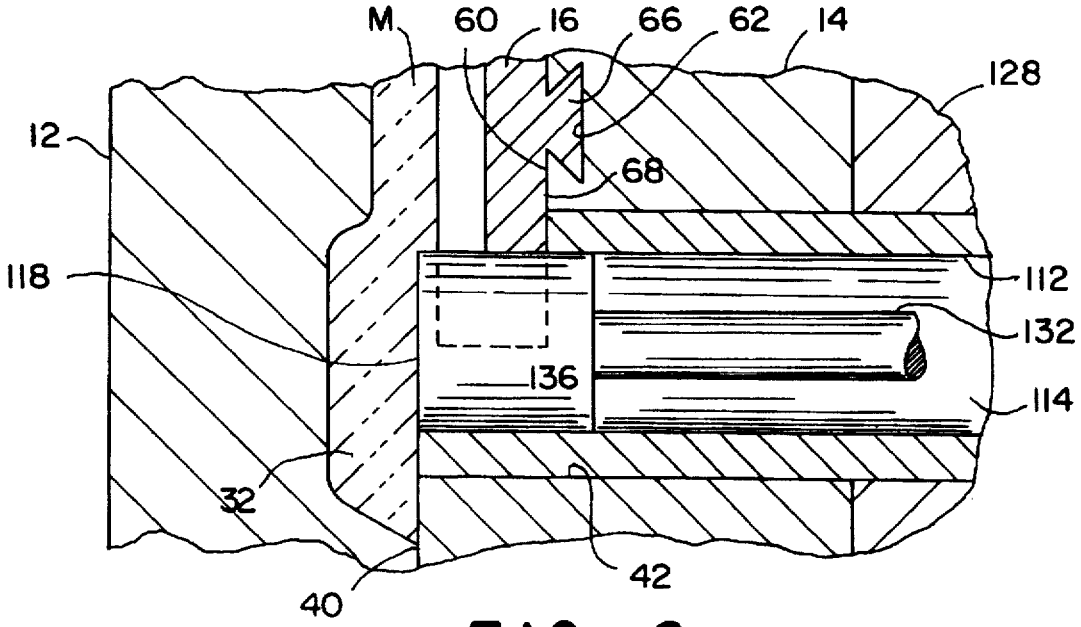
FIG. 6 is a sectional view taken along line VI—VI in FIG. 4 showing a portion of the die casting apparatus with the slide in the second position.

The multishot slide 16 is slidably mounted within trough 60 and is movable between a first position for directing molten material into the first die cavity (See FIG. 3) and a second position for directing molten material into the second die cavity (See FIG. 4). The multishot slide 16 is generally rectangular and includes a die face 50 that abuts with the ejector die face 30 when the die assembly 10 is closed. The slide 16 defines a pair of semi-circular recess 52 and 54 in the bottom edge 56 thereof. The first recess 52 is positioned to concentrically align with the shot sleeve 112 when the slide 16 is in the first position. Likewise, the second recess 54 is positioned to concentrically align with the shot sleeve 112 when the slide 16 is in the second position. Both recesses 54 include a diameter slightly larger than the outer diameter of the plunger 118, thereby allowing the advancing plunger 118 to extend beyond the slide 16. The die face 50 defines a passageway 58 extending from recess 54. The passageway 58 is a semi-circular trough extending partially across the slide die face 50. When the slide 16 is in the second position, the passageway 58 defines a flow path between the inlet 32 and the runner segment 36 allowing molten material to flow into the second die cavity. The slide 16 includes a dovetail rib 66 extending longitudinally along its rear face 68. The dovetail rib 66 is fitted within groove 62 to slidably interlock the slide 16 and cover die 14.

The die assembly also includes a control mechanism 26 for selectively moving the multishot slide 16 between the first and second positions. The control mechanism includes a conventional hydraulic cylinder 70 mounted to the cover die 14. A rod 72 extends from the hydraulic cylinder 70 to the slide 16 to impart the movement of the cylinder 70 to the slide 16.

The shot sleeve system 110 is generally conventional and includes a shot sleeve 112 having an internal bore 114, a plunger 118 seated within the internal bore 114, a plunger rod 132, and a hydraulic cylinder (not shown) for reciprocating the plunger 118 and plunger rod 132. The shot sleeve 112 extends into the cover die 14 through bore 42 and terminates flush with cover die face 40 such that the internal bore 114 is in fluid communication with the inlet 32 when the die assembly 10 is closed. The end of the shot sleeve 112 within the cover die 14 defines a notch 136 for allowing the slide 16 to intersect with internal bore 114. The shot sleeve 112 defines a pour hole (not shown) for introducing molten material into the internal bore 114. The plunger 118 is generally conventional and reciprocates within the shot sleeve 112 to inject the molten metal from the internal bore 114 into the die cavity 106. As noted above, the plunger 118 is actuated by a hydraulic cylinder (not shown).

Operation

Initially, the die assembly 10 is prepared for casting in a conventional manner. Generally, the ejector die 12 and cover die 14 are closed to define first and second distinct die cavities. The plunger 118 is fully retracted by operation of the hydraulic cylinder (not shown), and the multishot slide 16 is moved into its first position by operation of hydraulic cylinder 70. At this point, the shot sleeve 12 is ready to receive molten metal.

Molten metal M is ladled into the shot sleeve 112 through the pour hole (not shown) until the internal bore 114 is filled to the desired height. The plunger 118 is then extended by operation of a hydraulic cylinder (not shown). As the plunger advances, it forces the molten metal M from the shot sleeve 112 into the first die cavity via inlet 32 and runner 34. Because the passageway 58 is not aligned with the inlet 32, there is no way for molten material to flow into the second die cavity and only the first die cavity is filled. Once the plunger 118 is fully extended, the first article is allowed to cure enough so that it will not flow from the first die cavity and runner 34 when the plunger 118 is retracted. It is not necessary for the article to be fully cured because the die assembly 10 will not be opened until after the second article is east and cured. Optionally, high pressure may be developed in the molten metal for squeeze casting.

After the first article is sufficiently cured, the plunger 118 is fully retracted to prepare the shot sleeve system 110 for the next shot. In addition, the multishot slide 16 is moved to its second position by action of hydraulic cylinder 70. In its second position, the passageway 58 interconnects the inlet 32 with the runner segment 36 creating a flow path into the second die cavity. Molten metal is again ladled into the shot sleeve 112 to create the second shot. Once the desired volume of material is ladled into the shot sleeve 112, the plunger 118 is extended by operation of the hydraulic cylinder (not shown). As the plunger advances, it forces the molten metal from the shot sleeve 112 into the second die cavity via inlet 32, passageway 58, and runner segment 36. The first die cavity and runner 34 are filled with partially cured material M from the first shot, thereby preventing the material of the second shot from flowing into the first die cavity. Once the plunger 118 is fully extended, the second article is allowed to cure. Afterwards, the plunger 118 is retracted and the die assembly 10 is opened to remove the two cast articles.

First Alternative Embodiment

Figure 7:
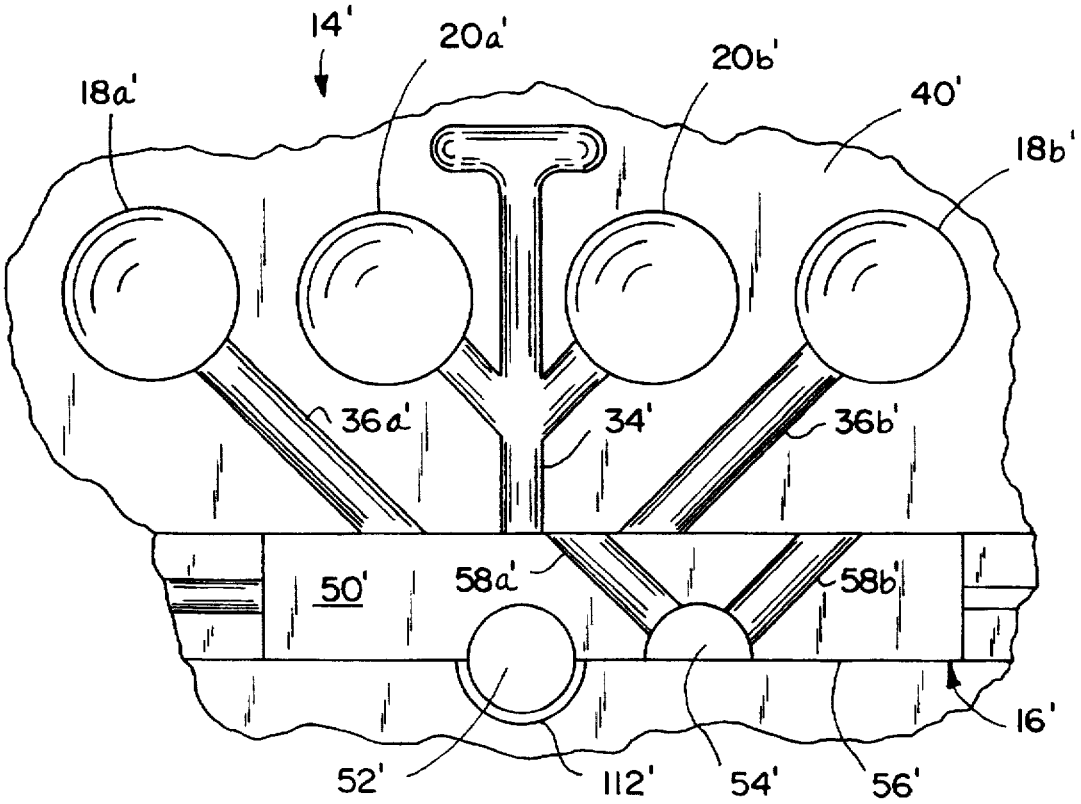
FIG. 7 is a partial front view of a first alternative cover die and slide showing the slide in the first position.

The configuration of the die assembly 10 shown in the preferred embodiment is merely exemplary. The die cavities, runners, and slide passageway will vary in number and disposition from application to application. For example, FIG. 7 illustrates the cover die 14' of an alternative embodiment which permits multiple die cavities to be filled with each shot. In this embodiment, the cover die 14' defines a plurality of voids 18*a–b*' and 20*a–b*' that cooperate with corresponding voids in the ejector die (not shown) to define two pair of die cavities (not shown). Each pair of die cavities is filled in a separate shot. Die face 40' also defines a runner 34' extending between the inlet (not shown) and the first pair of die cavities and a pair of runner segments 36*a–b*' from the second pair of die cavities partially to the inlet. Like multishot slide 16, slide 16' defines a pair of semi-circular recess 52' and 54' in the bottom edge 56' thereof. The first recess 52' is positioned to concentrically align with the shot sleeve 112' when the slide 16' is in the first position and the second recess 54' is positioned to concentrically align with the shot sleeve 112' when the slide 16' is in the second position. The slide die face 50' defines a pair of passageways 58*a–b*' that extend from recess 54' to runner segments 36*a–b*', respectively. When the slide 16' is in the second position, the passageways 58*a–b*' interconnect the inlet and the runner segments 36*a–b*' to define a flow path to each of the second pair of die cavities. The operation of this embodiment is substantially identical to that of the preferred embodiment.

Second Alternative Embodiment

Figure 8:
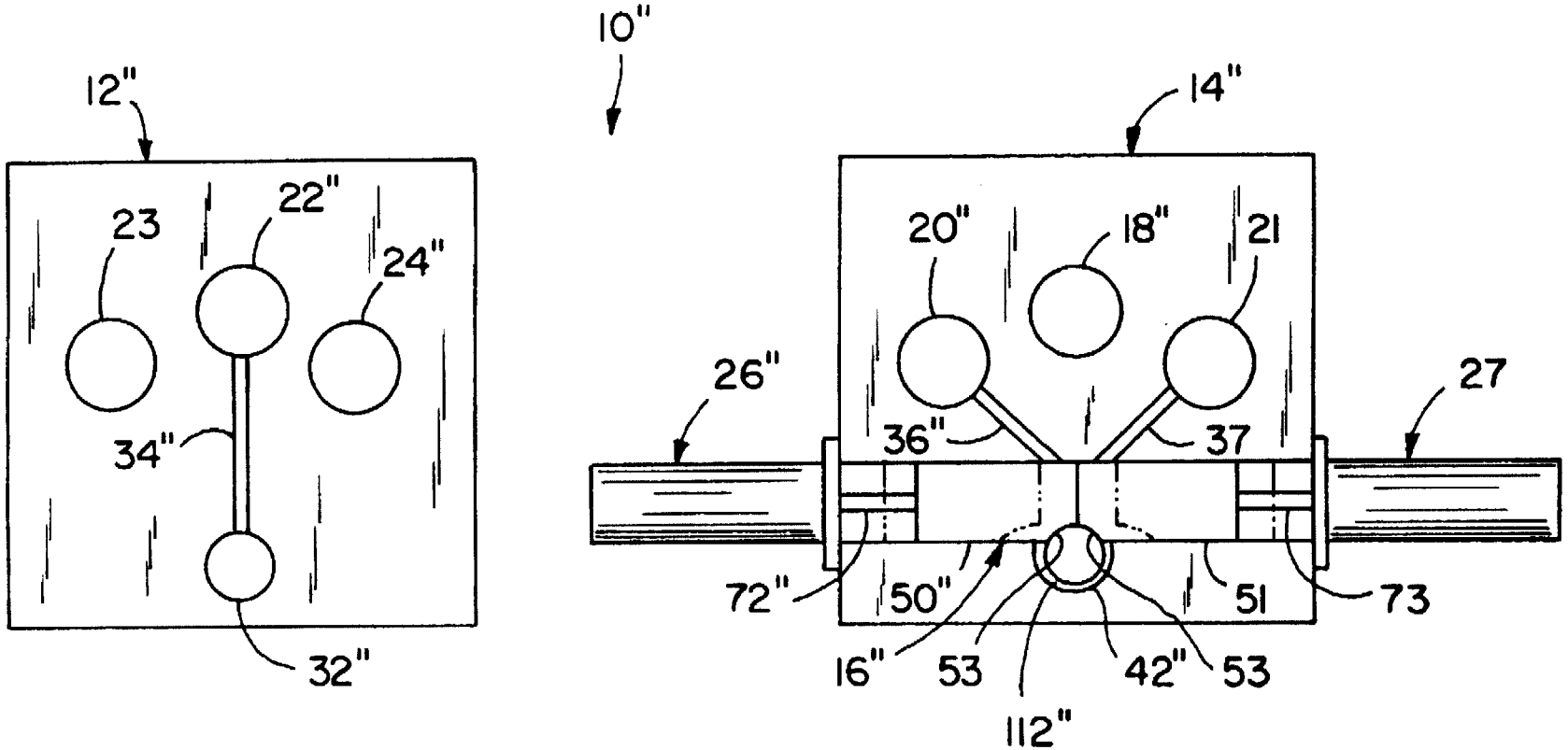
FIG. 8 is a front view of the ejector die and the cover die of a second alternative embodiment.

FIG. 8 illustrates a second alternative embodiment which permits three consecutive shots. The second alternative embodiment includes an ejector die 12" and cover die 14 that cooperate to define three distinct die cavities and a split multishot slide 16" that is movable to selectively direct molten material into any one of the three die cavities. The ejector die 12" defines inlet 32", runner 34", and voids 22", 23, and 24" The runner 34" interconnects the inlet 32" and cavity 22". The cover die 14' defines voids 18", 20", and 21, and runner segments 36" and 37 extending from voids 20" and 21, respectively. Voids 18" and 22" cooperate to define the first die cavity, voids 20" and 24" cooperate to define the second die cavity, and voids 21 and 23 cooperate to define the third die cavity. The split multishot slide 16" is slidably mounted to the cover die 14' and includes halves 50" and 51. The slide halves 50" and 51 are independently movable between a closed position (illustrated in solid lines in FIG. 8) and an open position (illustrated in phantom lines in FIG. 8). Slide half 50" is operatively connected to control mechanism 26" and slide half 51 is operatively connected to control mechanism 27. Each slide half 50" and 51 defines an arcuate notch 53 that matches the shape of the shot sleeve 112".

In operation, the ejector die 12" and cover die 14' arc closed and both slide halves 50" and 51 are moved into the closed position. The first shot of molten material is poured into the shot sleeve and injected into the die assembly 10". Because the slide halves 50" and 51 are closed, the molten material flows through runner 34" into the first die cavity. After the first shot is sufficiently cured, the plunger is retracted and slide half 50" is moved into the open position by control mechanism 26". This opens a flow path from the shot sleeve 112" to runner 36". The second shot of molten material is then poured into the shot sleeve 112" and injected into the die assembly 10". The frozen metal from the first shot seals runner 34" forcing the molten material to flow solely into the second die cavity. After the second shot is sufficiently cured, the plunger is again retracted and slide half 51 is moved into the open position by control mechanism 26". This opens a flow path from the shot sleeve 112" to runner 37. The third shot of metal is then poured into the shot sleeve 112" and injected into the die assembly 10". The frozen metal from the first two shots seals runners 34" and 36" forcing the injected metal to flow solely into the third cavity. The third article is allowed to cure and the die assembly 10" is opened to remove the three die cast articles.

The above descriptions are those of preferred embodiments of the invention. Various alterations and changes can be made without departing from the spirit and broader aspects of the invention as defined in the appended claims, which are to be interpreted in accordance with the principles of patent law including the doctrine of equivalents.

The embodiments of the invention in which an exclusive property or privilege is claimed are defined as follows:

1. A die assembly comprising:

an inlet adapted to receive molten material from a shot sleeve system;

an ejector die and cover die that cooperate to define a plurality of distinct die cavities; and a valve defining first and second openings and being movable between a first position in which said first opening fluidly connects said inlet and a first of said die cavities and a second position in which said second opening fluidly connects said inlet and a second of said die cavities; and said shot sleeve system including a movable plunger for forcing molten material from said shot sleeve system into said die cavities, said plunger movable between a retracted position in which molten material is supplied to said shot sleeve system and an extended position in which said plunger extends through one of said first and second openings in said valve, whereby said plunger can remain in said extended position while said molten material cures to prevent molten material from curing within said openings in said valve.

2. The die assembly of claim 1 wherein said die assembly further defines a runner extending between said first die cavity and said inlet, said runner defining a flow path from said inlet to said first cavity.

3. The die assembly of claim 2 wherein said die assembly defines a runner segment extending from said second die cavity only partially to said inlet, said second opening spanning said inlet and said runner segment when said valve is in said second position to define a flow path therebetween.

4. The die assembly of claim 3 wherein said first opening is further defined as a semi-circular recess that is adapted to concentrically align with a shot sleeve of said shot sleeve system when said valve is in said first position, and said second opening is further defined as a semi-circular recess that is adapted to concentrically align with said shot sleeve when said valve is in said second position, said passageway means being in fluid communication with said second recess.

5. The die assembly of claim 4 wherein said die assembly defines a trough for slidably receiving said valve.

6. The die assembly of claim 5 wherein said die assembly defines a dovetail groove extending longitudinally along said trough, said valve defining a dovetail rib slidably interfitted with said dovetail groove.

7. A multishot die assembly comprising:

a plurality of die cavities;

an inlet adapted to receive molten material from a shot sleeve;

a slide having first and second portions movably mounted to said die assembly for movement independently of each other, said first portion movable between a first position in which said inlet is in fluid communication with a first of said die cavities and a second position in which said inlet is in fluid communication with a second of said die cavities, said second portion movable between a first position in which said inlet is in fluid communication with one of said first and second cavities and a second position in which said inlet is in fluid communication with a third of said die cavities.

8. The assembly of claim 7 wherein said die assembly defines a full runner extending between said first die cavity and said inlet, a first partial runner extending from said second die cavity to an edge of said slide, and a second partial runner extending from said third die cavity to an edge of said slide.

9. The assembly of claim 8 wherein said first portion is movable between a closed position in which said first partial runner is sealed from said inlet and an open position in which said first runner is in fluid communication with said inlet.

10. The assembly of claim second portion is movable between a closed position in which said second partial runner is sealed from said inlet and an open position in which said second runner is in fluid communication with said inlet.

11. The assembly of claim 10 wherein said die assembly includes a cover die and an ejector die, said cover die defining said partial runners and movably supporting said slide, said ejector die defining said full runner.

12. A method for die casting multiple parts comprising the steps of:

providing a die assembly defining an inlet and a plurality of die cavities, the die assembly further including a valve operable between a first position in which the valve fluidly connects the inlet and a first of the cavities and a second position in which the valve fluidly connects the inlet and a second of the cavities;

moving the valve into the first position;

supplying a first shot of molten material to a shot sleeve of the die assembly;

advancing a plunger to drive the material of the first shot from the shot sleeve through a first opening in the valve into the first cavity, the plunger being extended entirely through the first opening in the valve;

curing the material of the first shot a sufficient amount such that the material of the first shot will not flow back into the first opening in the valve when the plunger is retracted;

retracting the plunger after said curing step;

moving the valve into the second position;

supplying a second shot of molten material to the shot sleeve of the die assembly;

advancing the plunger to drive the material through a second opening in the valve into the second cavity;

curing the material of the second shot; and opening the die assembly only after the material of the second shot is sufficiently cured.

13. The method of claim 12 wherein the die assembly includes a single cover die and a single ejector die; and further comprising the step of closing the ejector die and the cover die against each other to define said plurality of die cavities.

14. The method of claim 13 wherein both of said moving steps are further defined as moving the valve linearly with respect to the inlet.

* * * * *

UNITED STATES PATENT AND TRADEMARK OFFICE

CERTIFICATE OF CORRECTION

PATENT NO. : 5,730,204

DATED : March 24, 1998

INVENTOR(S) : Dennis S. Shimmell

It is certified that error appears in the above-indentified patent and that said Letters Patent is hereby corrected as shown below:

Column 8, Claim 10, Line 10:
After "claim" insert --9 wherein said--

Signed and Sealed this

Seventh Day of July, 1998

Bruce Lehman

*Attest:*

BRUCE LEHMAN

*Attesting Officer*

*Commissioner of Patents and Trademarks*